US007124491B2

(12) United States Patent
Toeniskoetter et al.

(10) Patent No.: US 7,124,491 B2
(45) Date of Patent: Oct. 24, 2006

(54) HEMMING APPARATUS AND METHOD USING A HORIZONTAL MOTION FOR ACTUATING THE DIE SETS

(75) Inventors: James B Toeniskoetter, Rochester Hills, MI (US); James J Steed, Pontiac, MI (US); Gerald F Erker, Sterling Heights, MI (US)

(73) Assignee: Tesco Engineering, Inc., Auburn Hills, MI (US)

( * ) Notice: Subject to any disclaimer, the term of this patent is extended or adjusted under 35 U.S.C. 154(b) by 277 days.

(21) Appl. No.: 10/722,827

(22) Filed: Nov. 26, 2003

(65) Prior Publication Data

US 2004/0107559 A1 Jun. 10, 2004

Related U.S. Application Data

(60) Provisional application No. 60/431,674, filed on Dec. 6, 2002.

(51) Int. Cl.
*B30B 7/00* (2006.01)
*B30B 1/26* (2006.01)

(52) U.S. Cl. ..... 29/434; 29/509; 29/464; 29/243.58; 29/243.5; 100/141; 100/142; 100/226; 100/229 R; 72/370.04; 72/263; 72/312

(58) Field of Classification Search ..... 29/434, 29/509, 243.58, 243.5; 72/370.04, 263, 414; 100/141, 142, 143

See application file for complete search history.

(56) References Cited

U.S. PATENT DOCUMENTS 5,086,633 A * 2/1992 Meyerle ..... 72/20.5
6,612,146 B1 * 9/2003 Saint Denis et al. ..... 72/306

* cited by examiner

*Primary Examiner*—George Nguyen
*Assistant Examiner*—Christopher Agrawal
(74) *Attorney, Agent, or Firm*—Fildes & Outland, P.C.

(57) ABSTRACT

An apparatus for horizontally actuating hemming and stamping die sets includes a horizontal base support and a roller device horizontally mounted thereon. A linear guidance system is set in and a drive support is vertically attached to the base support. A drive mechanism is supported and an anvil die set is held by the drive support. A vertical platen rests on top of the base support and is loosely guided by the linear guidance system. A punch die set is held by the vertical platen and a plurality of bushings are set therein. At least three guide shafts are secured to the anvil die set and each is engaged to one of the bushings of the punch die set. A plurality of link bars are attached to the vertical platen via link bar attachments and coupled to the drive mechanism. Actuation of the drive mechanism horizontally moves the vertical platen.

16 Claims, 5 Drawing Sheets

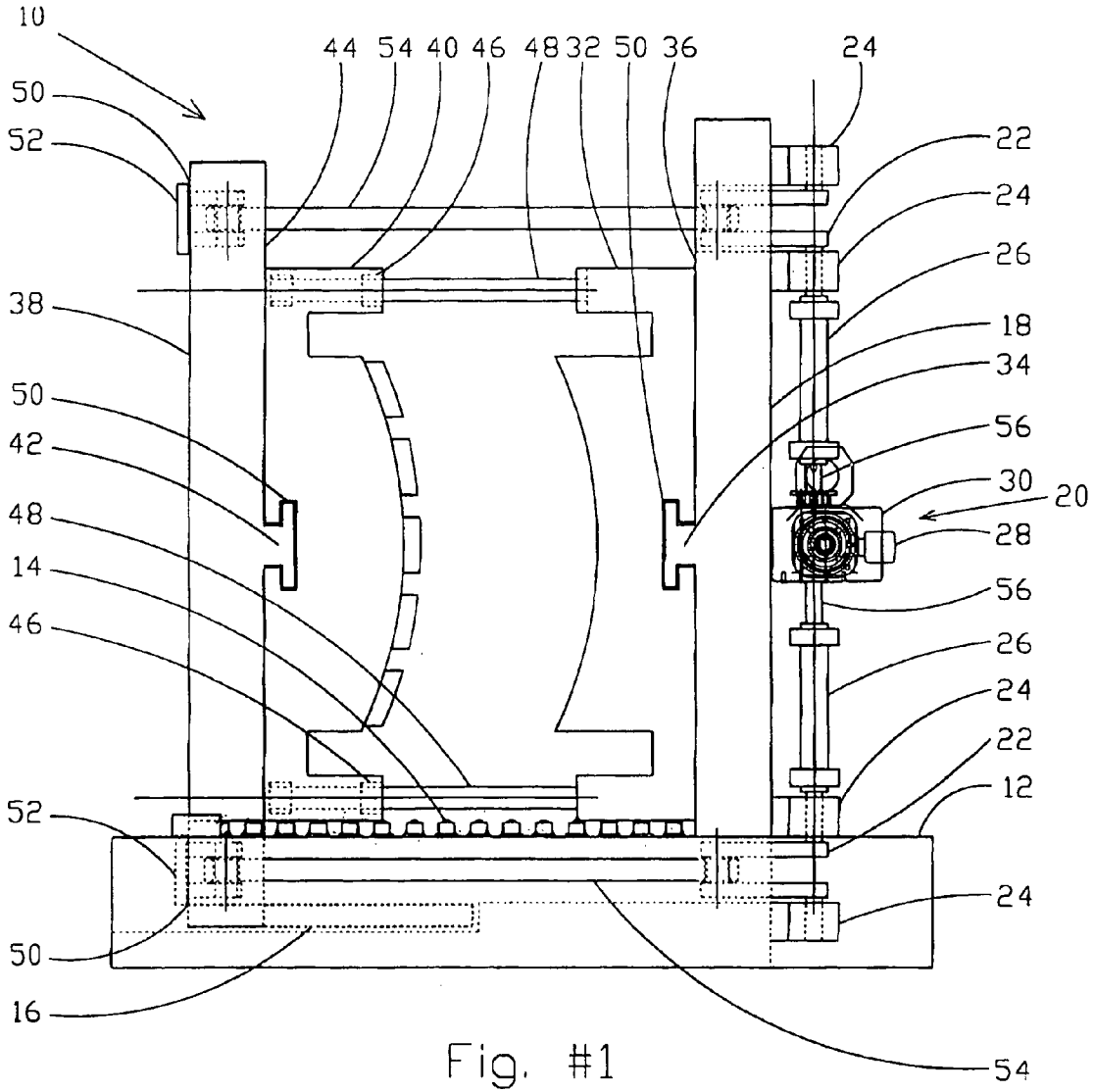
Fig. #1

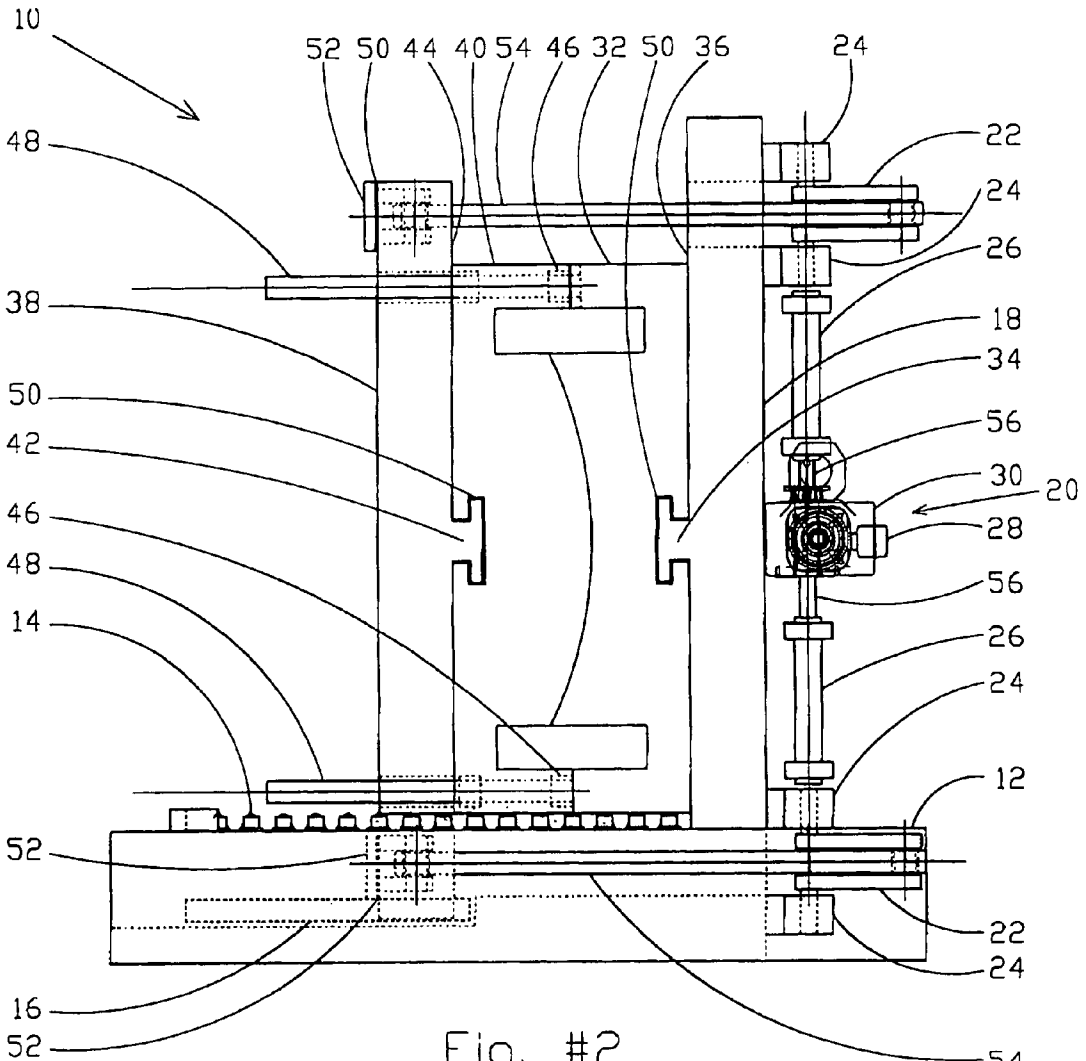
Fig. #2

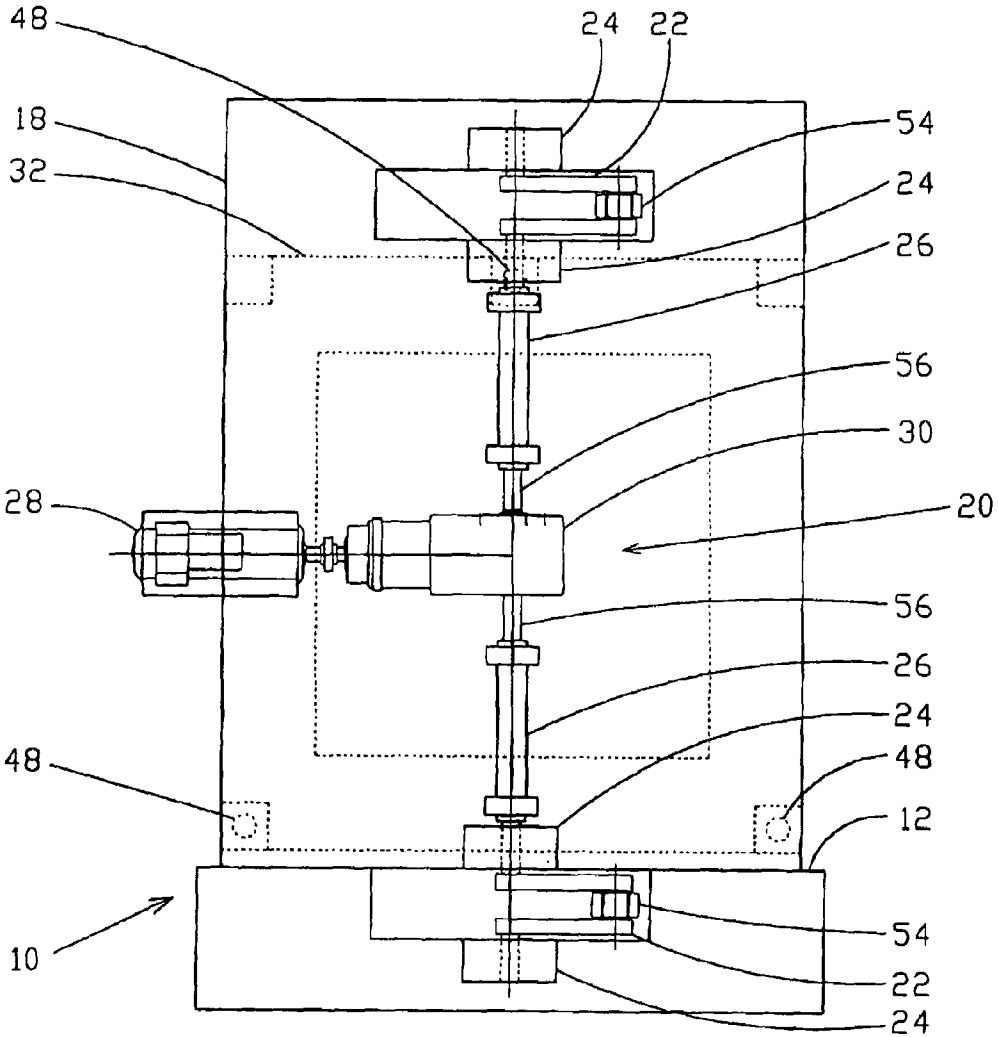
Fig. #3

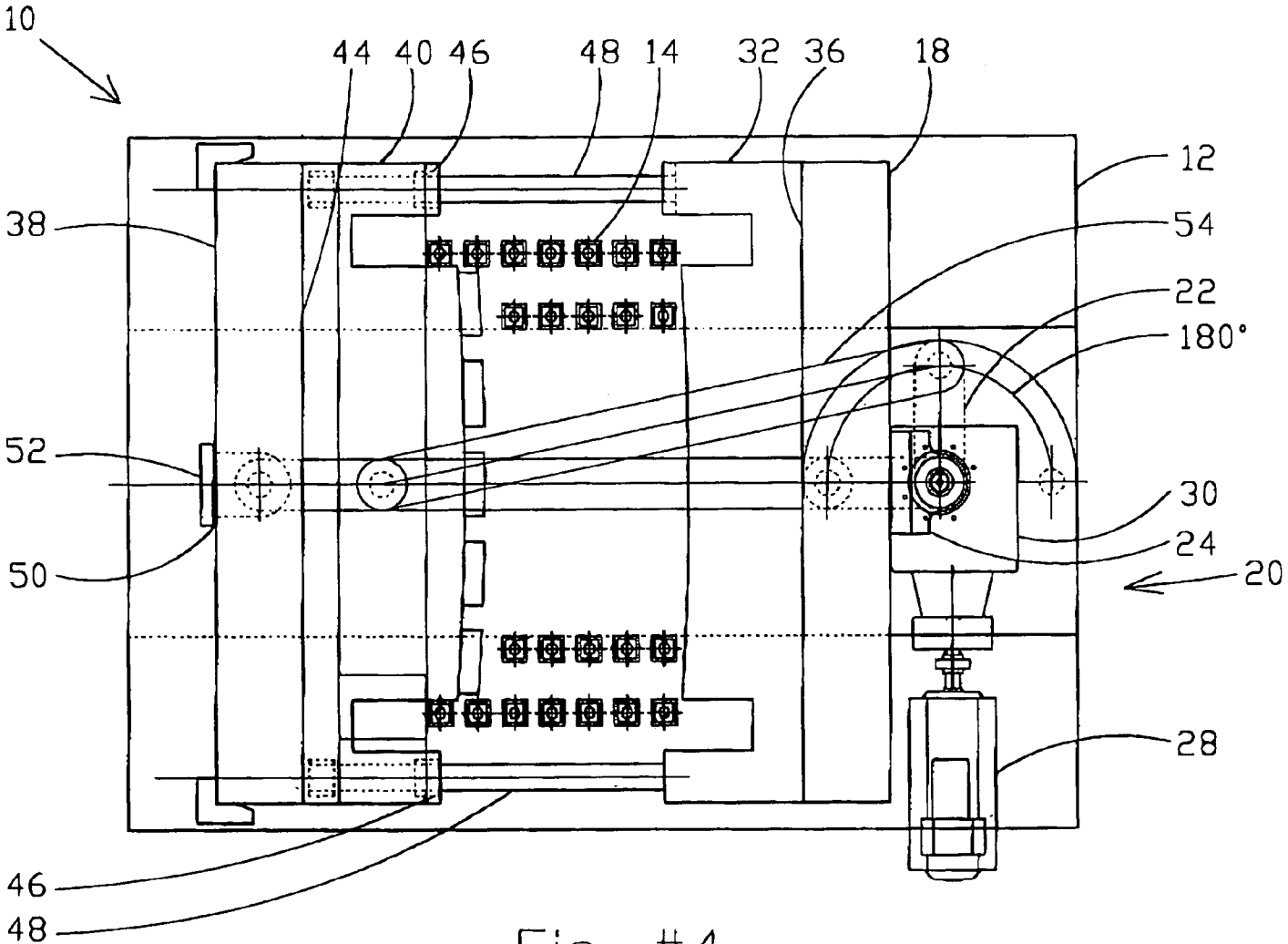
Fig. #4

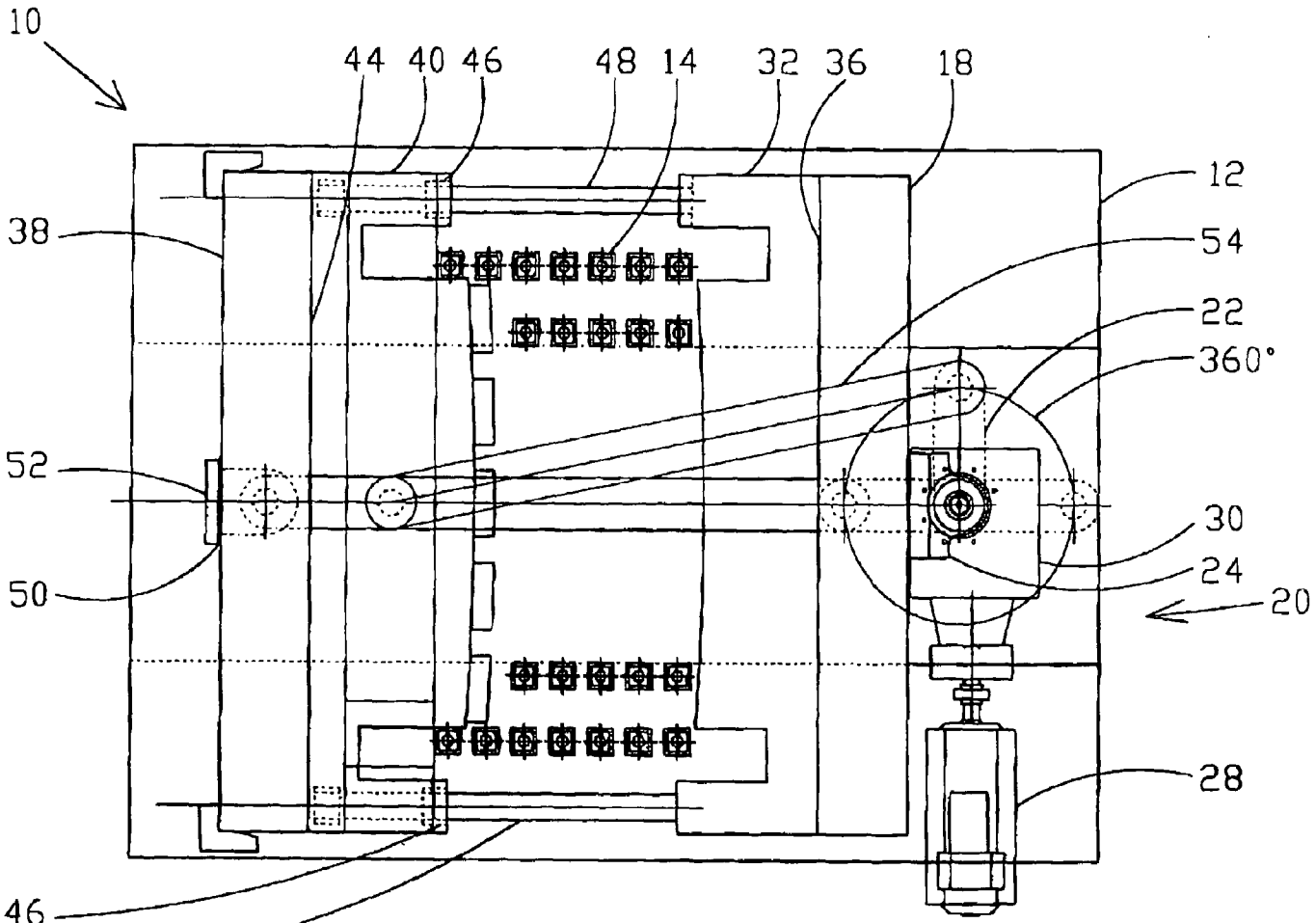
Fig. #5

HEMMING APPARATUS AND METHOD USING A HORIZONTAL MOTION FOR ACTUATING THE DIE SETS

CROSS REFERENCE TO RELATED APPLICATION

This application claims the benefit of U.S. Provisional Application No. 60/431,674, filed Dec. 6, 2002.

TECHNICAL FIELD

This invention relates to hemming and stamping presses for actuating die sets to impart hemmed flanges on closure panels and/or forming/stamping operations on sheet metal or aluminum parts.

BACKGROUND OF THE INVENTION

It is known in the art relating to hemming, stamping and forming presses to utilize a vertical structure consisting of a base or bed, columns, crown and platen that uses a raising and lowering motion of the platen or bed to actuate the die sets. The hemming, stamping and/or forming is accomplished through the driving motion of a hydraulic cylinder or electromechanical motor using either a ball screw type of linear actuator or crank arm arrangement with or without a flywheel. This style of press requires that the drive mechanism be sufficient or include means to overcome the gravitational weight of the moving die and press components. Usually this is accomplished by the addition of a counterbalance system and/or by upsizing the drive and its components to overcome the moving die and press component weight during the raising motion. These additions to the press are only needed to overcome gravity and do not add value to the press. The vertical type presses mentioned usually exceed the standard shipping height and need to be dismantled for shipment and re-assembled for operation at the manufacturing plant. These vertical type presses also require an accurate guidance system for the platen and a second guidance system for the die sets for achieving a final location during the work.

SUMMARY OF THE INVENTION

The present invention provides for the utilization of a side-by-side horizontal movement of the die sets to perform hemmed flanges on closure panels and for forming and stamping operations on sheet metal or aluminum parts. Accordingly, the present invention provides for cost reduction, elimination of the need to disassemble equipment for shipment, reduction of maintenance, increased safety and lower overall press height.

More specifically, a hemming/stamping apparatus in accordance with the present invention includes a horizontal base support, a roller device horizontally mounted on top of the horizontal base support and a linear guidance system set in the horizontal base support. A drive support is vertically attached to the horizontal base support, a drive mechanism is supported by the drive support and an anvil die set is held by the drive support. A vertical platen, to which a punch die set is loosely attached, rests on top of the horizontal base support and is loosely guided by the linear guidance system. Guide shafts are secured to the anvil die set and each is separately engaged to bushings set in the punch die set. Link bars are attached on one end to the vertical platen via link bar attachments and are coupled on the other end to the drive mechanism. Actuation of the drive mechanism causes the vertical platen and attached punch die set to move horizontally along the linear guidance system and roller device to complete the hemming or stamping process.

In a preferred arrangement, the anvil die set and the punch die set may be held by the drive support and the vertical platen respectively by connection features. Further, at least one load compliance device may be located on the platen connection feature, the drive support connection feature and/or the link bar attachments. Moreover, the roller device may use ball type rollers.

The drive mechanism may include a drive motor, a gearbox, at least one drive shaft, tube-type misalignment couplings, bearing blocks and crank arms. The crank arms may be designed to allow for 180° rotation and oscillation or optionally may be designed to allow for a continuous 360° motion. In either case, the drive shaft may be a single inline shaft connected to crank arms on either end or a dual drive shaft with each shaft connected to a crank arm on its end.

These and other features and advantages of the invention will be more fully understood from the following detailed description of the invention taken together with the accompanying drawings.

BRIEF DESCRIPTION OF THE DRAWINGS

In the drawings:

FIG. 1 is a front elevational view of a hemming apparatus in accordance with the present invention illustrating an open/loading position;

FIG. 2 is a front elevational view of the apparatus of FIG. 1 illustrating a closed/working position;

FIG. 3 is a side elevational view of the apparatus of FIG. 1 showing the drive end thereof;

FIG. 4 is a plan view of the apparatus of FIG. 1 illustrating 180° crank arm rotation and oscillation; and FIG. 5 is a plan view of the apparatus of FIG. 1 illustrating 360° crank arm rotation.

DETAILED DESCRIPTION OF THE INVENTION

Referring now to the drawings in detail, numeral 10 generally indicates a hemming apparatus using a horizontal motion for actuating the die sets in accordance with the present invention. As is hereinafter more fully described, hemming apparatus 10 utilizes a side-by-side horizontal movement of the die sets to impart/form hemmed flanges on closure panels and for forming and stamping operations on sheet metal or aluminum parts, thereby providing cost reduction, elimination of the need to disassemble equipment for shipment, reduction of maintenance, increased safety and lower overall press height.

Referring to FIG. 1, the hemming apparatus 10 is includes a horizontal base support 12. A roller device 14 is mounted on top of the horizontal base support 12 and a linear guidance system 16 is set in the horizontal base support 12. A drive support 18 is vertically attached to the horizontal base support 12 and supports a drive mechanism 20. The drive mechanism 20 includes crank arms 22, bearing blocks 24, tube-type misalignment couplings 26, a drive motor 28 and a gearbox 30. The drive motor 28 is connected to the gearbox 30, the gearbox 30 is connected to the tube-type misalignment couplings 26, the tube-type misalignment couplings 26 are connected to the bearing blocks 24 and the bearing blocks 24 are connected the crank arms 22. The tube-type misalignment couplings 26 allow for axial and angular misalignment between the gearbox 30 and the crank arms 22 and allow the hemming apparatus 10 to be designed to a minimum stiffness, resulting in reduction in the overall cost of the apparatus.

An anvil die set 32 is loosely held by the drive support 18 via a drive support connection feature 34 located in the center of an inside face 36 of the drive support 18. The drive support connection feature 34 centralizes the load that is applied to the anvil die set 32 through the drive mechanism 20 during the intensification portion of the press stroke. The drive support connection feature 34 is designed to allow pass through die set indexing during a die change sequence. A vertical platen 38 rests on top of the horizontal base support 12. A punch die set 40 is loosely held by the vertical platen 38 via a platen connection feature 42 located in the center of an inside face 44 of the vertical platen 38. The platen connection feature 42 centralizes the load that is applied to the punch die set 40 through the drive mechanism 20 during the intensification portion of the press stroke. The platen connection feature 42 is designed to allow pass through indexing during a die change sequence. The vertical platen 38 is loosely guided by the linear guidance system 16 during its travel and is held to a positive location by the linear guidance system 16 when it is in the open position. This allows for positive location of the vertical platen 38 during the loading and unloading of the die sets 32, 40.

Bushings 46 are located in the punch die set 40. Three or four guide shafts 48 are secured to the anvil die set 32 and each guide shaft 48 is engaged to a separate bushing 46 of the punch die set 40. The guide shafts 48 guide the punch die set 40 and vertical platen 38 during their linear movement while the roller device 14 supports their weight.

A compliance device 50 is located either on the platen connection feature 42, the drive support connection feature 34 or on link bar attachments 52 located on the vertical platen 38. The compliance device 50 is adjustable to allow for different tonnage settings based on product needs. For example, when the compliance device 50 is located on the platen connection feature 42, the compliance device 50 contacts the punch die set 40 during linear travel and allows for the application of the proper tonnage to hem or stamp the working piece.

Link bars 54 are attached on one end to the vertical platen 38 and are coupled on the other end to the crank arms 22 of the drive mechanism 20. The crank arms 22 are designed in a way to allow for 180° rotation to actuate the stroke of the vertical platen 38. This limited oscillating motion is used on the basis of the crank arms' configuration. Utilizing the 180° rotation and an oscillating motion, the throws on the crank arms 22 can be designed for easier manufacturing, assembly and disassembly of the linkage and drive mechanism 20. This also lowers the manufacturing cost of these components. Alternatively, these same advantages can be obtained by using a continuous 360° motion of the crank arms 22 made possible by changing the throws on the crank arms 22. This arrangement would allow for a single directional rotation of the gearbox 30 and the drive motor 28, enabling a looser key to key-way fit between the shafts 56 of the gearbox 30, the drive motor 28, the tube type misalignment couplings 26 and the crank arms 22. Both the 180° and the 360° drive arrangement can be comprised of a single inline drive shaft arrangement with a crank arm 22 at both ends of the shaft and link bars 54 connected to the vertical platen 38 or a dual drive shaft arrangement with crank arms 22 at both ends and link bars 54 connected to the vertical platen 38. This eliminates the possibility of a walking motion of the punch die set 40 during linear travel if the hemming/stamping process requires a closer guidance system through the complete cycle.

Turning now to FIGS. 1 through 4, the hemming/stamping apparatus begins in the open/loading position as shown in FIG. 1. Activation of the drive motor 28 turns the gears of the gearbox 30 which simultaneously spin the shafts 56. The spinning of the shafts 56 cause the crank arms 22 to rotate as shown in FIG. 4. The rotation of the crank arms 22 180° moves the vertical platen 38 and the punch die set 40 along the linear guidance system 16 and roller device 14 from the open/loading position of FIG. 1 to the closed/working position as shown in FIG. 2. Reversing rotation of crank arms 22 180° moves the vertical platen 38 and the punch die set 40 from the closed/working position in FIG. 2 back to the open/loading position in FIG. 1.

Referring to FIGS. 1 through 3 and 5, the hemming/stamping apparatus begins in the open/loading position as shown in FIG. 1. Activation of the drive motor 28 turns the gears of gearbox 30 which simultaneously spin the shafts 56. The spinning shafts 56 cause the crank arms 22 to rotate as shown in FIG. 5. The rotation of crank arms 22 180° moves the vertical platen 38 and the punch die set 40 along the linear guidance system 16 and roller device 14 from the open/loading position of FIG. 1 to the closed/working position as shown in FIG. 2. Continuing the rotation of crank arms 22 an additional 180° in the same direction completing a 360° rotation moves the vertical platen 38 and the punch die set 40 along the linear guidance system 16 and roller device 14 from the closed/working position of FIG. 2 back to the open/loading position as shown in FIG. 1.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An apparatus for horizontally actuating hemming and stamping die sets, said apparatus comprising:

a horizontal base support;

a roller device horizontally mounted on top of said horizontal base support;

a linear guidance system set in said horizontal base support;

a fixed drive support vertically attached to said horizontal base support;

a drive mechanism supported by said drive support;

an anvil die set held by said drive support;

a vertically extending platen, said vertically extending platen resting on top of the horizontal base support and loosely guided by said linear guidance system;

a punch die set held by said vertical platen;

a plurality of bushings set in the punch die set;

at least three guide shafts, each secured to said anvil die set on one end and each engaged to one of said bushings of said punch die set on the other end; and a plurality of link bars attached on one end to said vertical platen via link bar attachments and coupled on the other end to said drive mechanism, wherein the actuation of the drive mechanism moves said link bars and the attached vertical platen in a horizontal direction along the linear guidance system relative to said drive support.

2. The apparatus of claim 1 wherein the anvil die set is held on the drive support by a drive support connection feature located in the center of the inside face of the drive support.

3. The apparatus of claim 1 wherein the punch die set is held on the vertical platen by a platen connection feature located in the center of the inside face of the vertical platen.

4. The apparatus of claim 1 further comprising at least one compliance device.

5. The apparatus of claim 4 wherein the compliance device is located on a platen connection feature of the platen.

6. The apparatus of claim 4 wherein the compliance device is located on the a drive support connection feature of the drive support.

7. The apparatus of claim 4 wherein the compliance device is located on the link bar attachments.

8. The apparatus of claim 1 wherein the roller device uses ball type rollers.

9. The apparatus of claim 1 wherein the drive mechanism includes a plurality of crank arms, a plurality of bearing blocks, a plurality of tube-type misalignment couplings, a drive motor, a gearbox and at least one drive shaft, said drive motor being connected to said gearbox, said gearbox being connected to said drive shaft, said drive shaft being connected to said tube-type misalignment couplings, said tube-type misalignment couplings being connected to said bearing blocks and said bearing blocks being connected to said crank arms.

10. The apparatus of claim 9 wherein the crank arms are designed to allow for 180 ° rotation and oscillation.

11. The apparatus of claim 9 wherein the crank arms are designed to allow for a continuous 360 ° motion.

12. The apparatus of claim 10 wherein the drive shaft is a single inline shaft arrangement.

13. The apparatus of claim 10 wherein the drive shaft is a dual drive shaft arrangement.

14. The apparatus of claim 11 wherein the drive shaft is a single inline shaft arrangement.

15. The apparatus of claim 11 wherein the drive shaft is a dual drive shaft arrangement.

16. A method for horizontally actuating hemming and stamping die sets comprising the steps of:

supporting a vertically extending platen for horizontal motion and a drive support on a horizontally disposed base support;

attaching a punch die set to said platen and a drive mechanism and an anvil die set to said drive support;

coupling crank arms of said drive mechanism to said platen via link bars;

actuating said drive mechanism to move said platen and said punch die set across said horizontal base support to contact the anvil die set, whereby the side-by-side horizontal movement of the die set is used to perform hemming and stamping operations on a working piece.

* * * * *